US008348074B2

(12) United States Patent
Dahlstrom et al.

(10) Patent No.: US 8,348,074 B2
(45) Date of Patent: Jan. 8, 2013

(54) CONNECTOR AND CONNECTION BLOCK IN A TRAIN COUPLER ARRANGED FOR CONNECTION OF A RAIL VEHICLES

(75) Inventors: Tommy Dahlstrom, Borlange (SE); Anders Westman, Falun (SE)

(73) Assignee: Dellner Couplers AB, Falun (SE)

( * ) Notice: Subject to any disclaimer, the term of this patent is extended or adjusted under 35 U.S.C. 154(b) by 61 days.

(21) Appl. No.: 12/527,519

(22) PCT Filed: Feb. 14, 2008 (Under 37 CFR 1.47)

(86) PCT No.: PCT/SE2008/050174

§ 371 (c)(1), (2), (4) Date: Mar. 30, 2010

(87) PCT Pub. No.: WO2008/100221

PCT Pub. Date: Aug. 21, 2008

(65) Prior Publication Data

US 2010/0326942 A1 Dec. 30, 2010

(30) Foreign Application Priority Data

Feb. 15, 2007 (SE) ..... 0700377

(51) Int. Cl.
*B61G 5/06* (2006.01)

(52) U.S. Cl. ..... 213/1.3; 213/75 R

(58) Field of Classification Search ..... 213/1.3; 280/422; 439/527, 540.1
See application file for complete search history.

(56) References Cited

U.S. PATENT DOCUMENTS

| | | | | | |
|---|---|---|---|---|---|
| 3,506,139 | A | * | 4/1970 | Cope et al. | 213/1.3 |
| 3,699,504 | A | * | 10/1972 | Huber | 439/585 |
| 3,845,453 | A | * | 10/1974 | Hemmer | 439/578 |
| 4,284,311 | A | * | 8/1981 | Forster et al. | 439/34 |
| 4,483,575 | A | * | 11/1984 | Kruger et al. | 439/102 |
| 4,957,208 | A | * | 9/1990 | Ta | 213/1.3 |
| 5,195,906 | A | * | 3/1993 | Szegda | 439/394 |

(Continued)

FOREIGN PATENT DOCUMENTS

EP 1 753 089 2/2007

(Continued)

OTHER PUBLICATIONS

International Search Report dated May 8, 2008, from corresponding PCT application.

(Continued)

*Primary Examiner* — Jason C Smith
(74) *Attorney, Agent, or Firm* — Young & Thompson

(57) ABSTRACT

A connector by which data signals are conducted between data communication networks separately installed in coupled rail vehicles, includes a contact holder arranged to be seated in a train coupler connection block; a metal contact housing arranged for insertion in a forward end of the contact holder, and a metal contact member seated in the contact housing, the contact member extending through the contact housing to a conductor termination seated in a rear end of the contact holder. A connection block in a train coupler, wherein a multiplicity of connectors are arranged in the front of the connection block and adapted for mating with connectors of a corresponding connection block for electrically connecting rail vehicles that are interconnected by the train coupler, and wherein at least some of the connectors are effective for conducting signals at 100 MHz frequency range via electromagnetically shielded contacts, is also described.

5 Claims, 2 Drawing Sheets

U.S. PATENT DOCUMENTS

Figure 1:
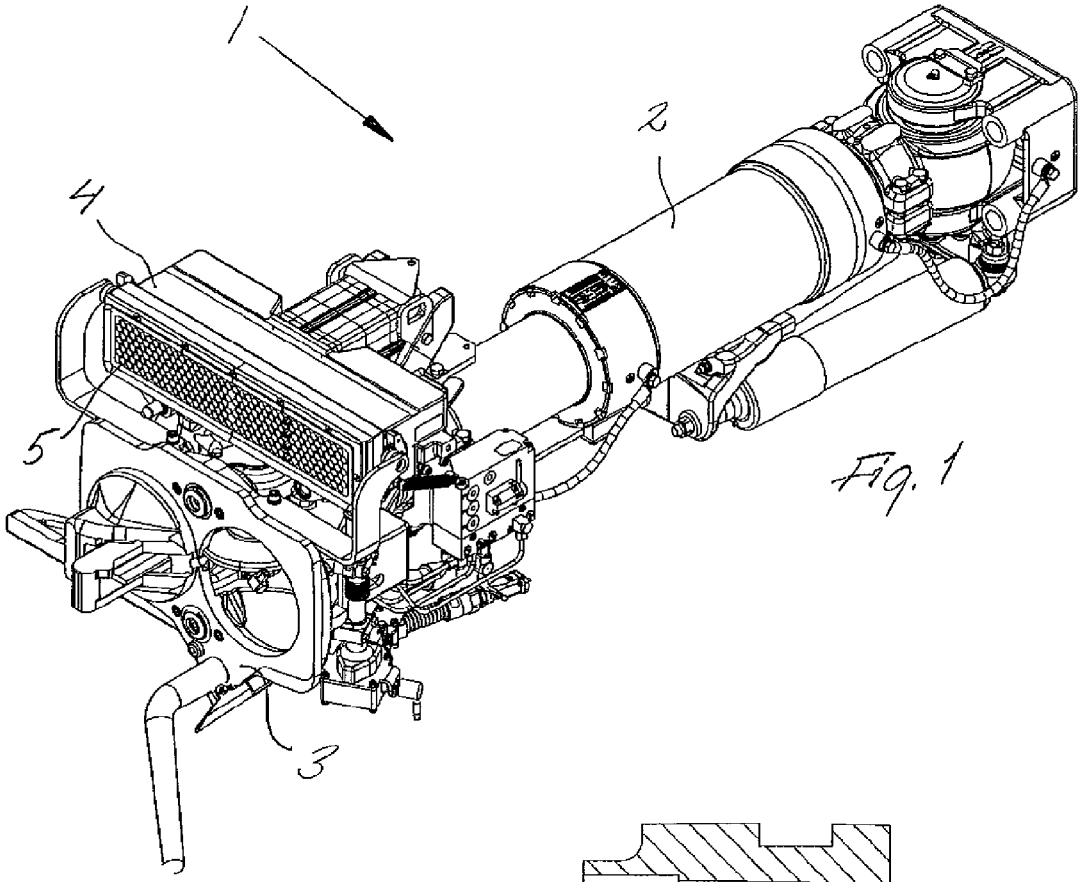

| | | | | |
|---|---|---|---|---|
| 5,318,459 | A * | 6/1994 | Shields | 439/527 |
| 5,580,275 | A * | 12/1996 | Bozek | 439/577 |
| 5,876,219 | A * | 3/1999 | Taylor et al. | 439/74 |
| 6,474,488 | B1 * | 11/2002 | Sullivan | 213/1.3 |
| 6,883,973 | B2 * | 4/2005 | Meyer | 385/70 |
| 7,329,149 | B2 * | 2/2008 | Montena | 439/584 |
| 7,345,639 | B2 * | 3/2008 | Prill et al. | 343/711 |
| 7,473,128 | B2 * | 1/2009 | Montena | 439/584 |
| 7,488,223 | B1 * | 2/2009 | Miyazaki et al. | 439/874 |
| 7,601,024 | B2 * | 10/2009 | Martich | 439/540.1 |
| 2004/0182812 | A1 * | 9/2004 | Alvarez et al. | 213/1.3 |
| 2006/0031590 | A1 * | 2/2006 | Monette et al. | 709/249 |
| 2006/0181398 | A1 * | 8/2006 | Martich et al. | 340/310.11 |
| 2009/0029587 | A1 * | 1/2009 | Miyazaki et al. | 439/527 |
| 2010/0038334 | A1 * | 2/2010 | Kontetzki | 213/1.3 |
| 2010/0044333 | A1 * | 2/2010 | Marvel et al. | 213/1.3 |
| 2010/0326942 | A1 * | 12/2010 | Dahlstrom et al. | 213/1.3 |

FOREIGN PATENT DOCUMENTS

| | | | |
|---|---|---|---|
| EP | 1 753 089 | A2 | 2/2007 |
| JP | 2000173725 | A | 6/2000 |
| JP | 2001155822 | A | 6/2001 |
| JP | 2002211397 | A | 7/2002 |
| JP | 2003331998 | A | 11/2003 |
| JP | 2006232203 | A | 9/2006 |
| JP | 2006341842 | A | 12/2006 |
| JP | 2007076591 | A | 3/2007 |
| WO | 99/36999 | | 7/1999 |
| WO | 03028299 | A1 | 4/2003 |
| WO | 2006/075767 | | 7/2006 |

OTHER PUBLICATIONS

Translation of Japanese Office Action, dated Oct. 1, 2012, from corresponding JP application.

Australian Office Action in corresponding 2008216907 dated Aug. 31, 2012.

* cited by examiner

CONNECTOR AND CONNECTION BLOCK IN A TRAIN COUPLER ARRANGED FOR CONNECTION OF A RAIL VEHICLES

TECHNICAL FIELD OF THE INVENTION

The present invention relates to a connector supported in a connection block on a train coupler, the connector being adapted for connecting data communication networks installed in rail vehicles to be interconnected by the train coupler.

BACKGROUND AND PRIOR ART

In order to meet customer demands for communication via the Internet during travel, broadband networks can be installed in rail vehicles for high speed data communication. It is preferred that networks which are separately installed in rail vehicles are inter-connectable for sharing hardware equipment and software that is necessary for administration of the data communication network. A connector for this purpose must meet with a number of specific demands:

Primarily, the connector shall provide a data transfer capacity in compliance at least with Ethernet standard IEEE 802.3u, requiring 100 Mbit data transfer capacity per second.

The high speed data transfer requires conducting of signals at a frequency of 100 MHz, and thus the connector needs electromagnetic shielding to avoid interference from other electromagnetic sources, such as adjacent connectors.

The connector must further withstand environmental stress including moisture, dust, extreme temperatures, as well as dynamic loads and vibration generated in coupling operations and during run of a train.

Preferably, a connector for the purpose should be arranged for automatic connection/disconnection of the data communication networks upon coupling/uncoupling of rail vehicles.

SUMMARY OF THE INVENTION

An object for the present invention is to provide a connector in a connection block on a train coupler, wherein said connector and connection block are capable of conducting signals at 100 MHz frequency range between rail vehicles interconnected in a train.

Another object of the present invention is to provide a connector in a connection block on a train coupler, wherein connectors are readily and individually exchangeable.

Yet another object of the present invention is to provide a connector in a connection block on a train coupler allowing conducting of signals at 100 MHz frequency and arranged for automatic connection/disconnection upon coupling/uncoupling of rail vehicles in a train.

One or several of these objects are achieved in a connector and a connection block as defined in the accompanying claims.

Briefly, the present invention provides a connector by which data signals are conducted between data communication networks separately installed in coupled rail vehicles. The connector comprises a contact holder arranged to be seated in a train coupler connection block and a metal contact housing arranged for insertion in a forward end of the contact holder, wherein a metal contact member is seated in the contact housing and arranged to extend electrically separated through the contact housing to a conductor termination which is seated in a rear end of the contact holder.

By this solution it is achieved that electromagnetically shielded connectors for the subject high frequencies can be installed at any desired position in a connection block, without requiring modification of the connection block. In other words, the same contact holder can optionally be used for mounting of the shielded connectors adapted for connecting 100 Mbit/second data conductors, or for mounting of solid connectors adapted for connection of power conductors.

The contact housing and the contact member are together dismountable from the contact holder while the latter remains seated in the connection block. A worn out or damaged connector is thus individually exchangeable from the front of the connection block, without requiring dismounting of the contact holder from the connection block. The solution provides benefits in terms of both reduced maintenance times and improved economy.

It is preferred that the contact housing extends forward of the contact member to engage a mating connector in advance of the contact member upon connection. The contact member is this way protected from damage and provided a guided connecting with a mating contact member.

In one preferred embodiment, the contact member comprises a metal body having a diameter and a rod of a smaller diameter extending from the body. The body is seated in a central axial bore through the contact housing and the rod reaches axially outside a rear end of the contact housing. The body and rod may be integrally formed and made through turning of a suitable metal or metal alloy material. One suitable material is stainless steel, another is cupper, e.g.

The structure of this embodiment provides a reliable operation in spite of small dimensions, the diameter of the contact member ranging from about or even below 1 mm in the rod section to about 3 mm in the body section.

The contact holder has a forward seat arranged for seating the rear end of the contact housing, and a rear seat separated from the forward seat. The rear seat is arranged for seating a cable conductor, and a passage from the forward seat to the rear seat is arranged for passing of the rod of the contact member into the rear seat.

This embodiment provides unlimited versatility in the designation of connectors for high frequency data transfer and for transfer of electrical power at low frequency.

The contact member is inserted into the central bore through the contact housing, and from the front end of the contact housing. The contact member is axially arrested between forward and rear radial shoulders formed in the bore through the contact housing, wherein spacer elements made of dielectric material are interposed between the shoulders and the body of the contact member.

One of the spacer elements is made of elastic material and flexible in a radial dimension. While inserted into the bore under radial compression, the flexible spacer element is allowed to expand radially behind the forward shoulder, this way arresting the body of the contact member behind the forward shoulder.

The embodiment provides simple mounting through insertion of the contact member with spacer elements supported thereon, from the forward end of the contact housing until the flexible spacer member snaps behind the forward shoulder.

The spacer elements are advantageously coaxially supported on the contact member and effective for centring of the contact member in concentric relation with the contact housing. This way the spacer elements ensure formation of an annular gap between the body of the contact member and the surrounding wall of the bore through the contact housing, by which gap the contact member is electrically separated from the contact housing.

In a connector wherein the contact housing has the shape of a female contact, the contact member comprises a contact pin extended from the forward end of the body of the contact member.

In a connector wherein the contact housing has the shape of a male contact, the contact member comprises a contact sleeve mouthing in the forward end of the body of the contact member.

Arranged as specified above, the available dimension of the connector is optimally utilized.

Analogously, the present invention provides a connection block in a train coupler wherein a multiplicity of connectors are arranged in the front of the connection block and adapted for mating with connectors of a corresponding connection block for electrically connecting rail vehicles that are interconnected by the train coupler. At least some of the connectors in the connection block are effective for conducting signals at 100 MHz frequency range via electromagnetically shielded contacts arranged as discussed above.

A train coupler and a rail vehicle data communication network are likewise provided, achieving data transfer at 100 Mbit/second via the connection block and connectors as explained above.

SHORT DESCRIPTION OF THE DRAWINGS

Figure 2:
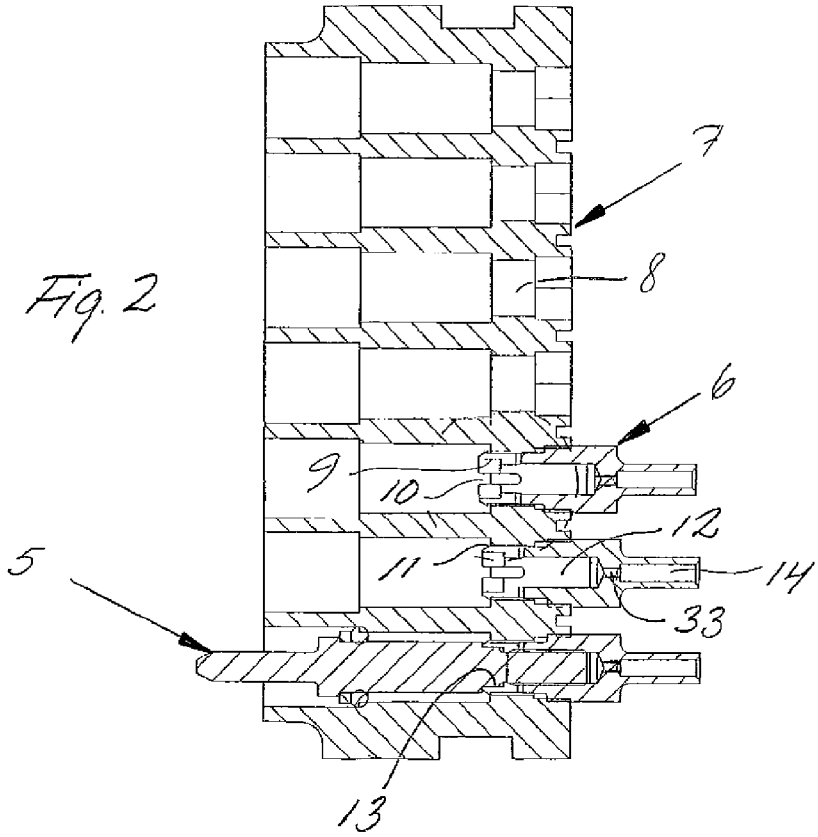
Figure 3A:
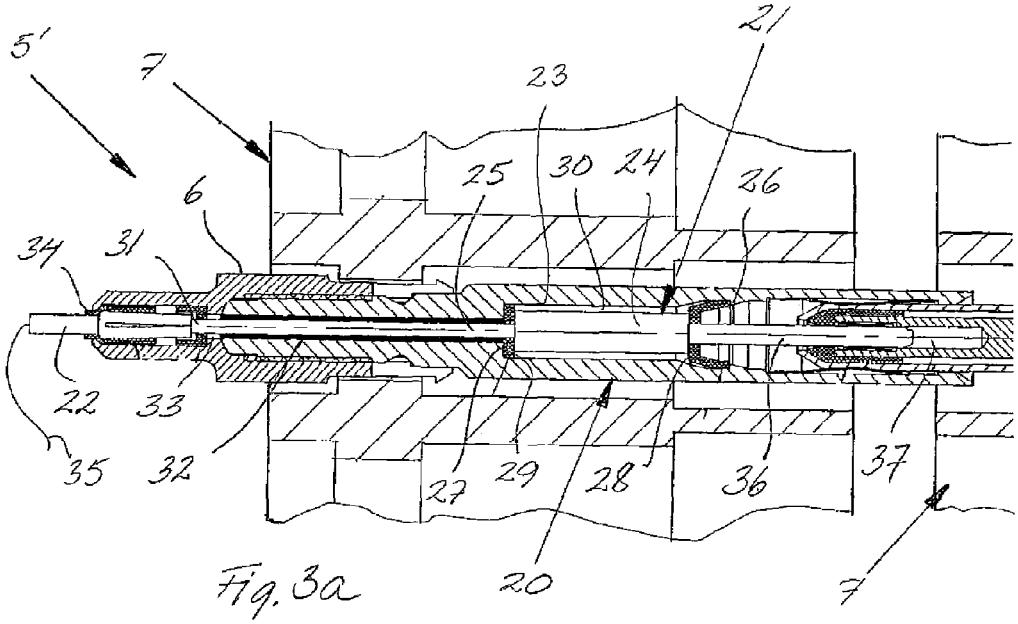
Figure 3B:
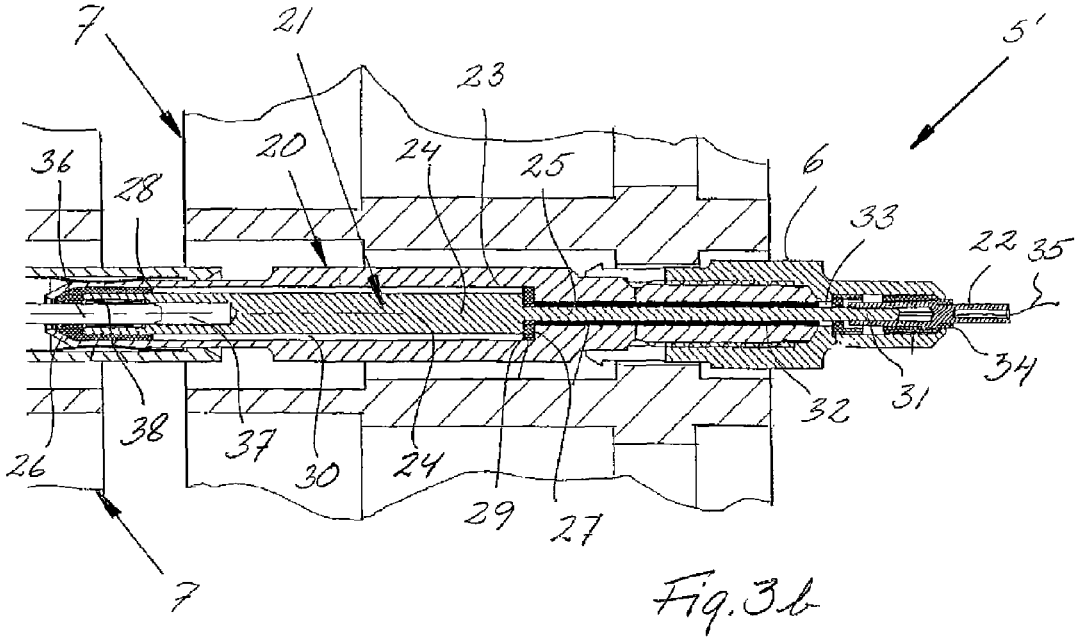

The invention is explained in more detail below and with reference to the accompanying drawings. In the drawings, FIG. 1 shows a train coupler carrying a connection block, the front of which is facing forward for mating with a corresponding connection block on a meeting train coupler in connecting operation;

FIG. 2 is a sectional view through a connection block, schematically illustrated;

FIGS. 3*a* and 3*b* are longitudinal sections through a pair of interconnected connectors according to the present invention.

DETAILED DESCRIPTION OF A PREFERRED EMBODIMENT

With reference to FIG. 1 a train coupler 1 is shown, the train coupler comprising a drawbar 2 and a coupler head 3. In operation, the drawbar 2 is attached to a rail vehicle chassis which is omitted from the drawing, and the coupler head is arranged for coupling to a corresponding coupler head of a meeting train coupler.

A connection block 4 is supported on the coupler head, the connection block comprising a multiplicity of connectors 5 facing forward in the front face of the connection block 4. Though not illustrated in the drawing it will be understood that in operation a bunch of conductors will extend from the rail vehicle to the rear face of the connection block. The arrangement of connection block and connectors provides automatic connection with mating connectors in a corresponding connection block upon coupling to a meeting and correspondingly equipped train coupler. Thus in the connected mode, the connection block and connectors transfer electrical power and signals between the interconnected rail vehicles.

The connectors 5 that are supported in the connection block 4 can generally be explained to include a female shape contact and a male shape contact which are connectable in a coaxial relation. Thus the connectors 5 typically have a rotation symmetric shape and include in several aspects a common structure, for which reason the following description is readable on both female and male connectors if not otherwise stated.

The connectors 5 are operable for transfer of electric power and/or signals for operation control between interconnected rail vehicles. In order to serve a rising number of functions in rail vehicles, the connectors 5 are designed to be accommodated in a large quantity in the connection block. The connectors are typically arranged in parallel horizontal and vertical rows as illustrated, leaving a rather limited space between neighbouring connectors.

The connectors 5 are mounted individually in the connection block 4 by means of contact holders 6, as seen in the sectional view of FIG. 2. In the connection block 4, the contact holder 6 is seated in a body 7 which is made of dielectric material and secured in the connection block. More specifically, the contact holder 6 is inserted in a seat 8 which is formed through the body 7. In the illustrated embodiment, the contact holder 6 is arranged for being snapped into the seat. To this purpose, the contact holder has a forward end formed as a sleeve 9 which is compressible in a radial dimension in result of axial slots 10 mouthing in the forward end of the contact holder. A radially protruding lip 11 terminates the forward end. Under radial compression of the forward end, the contact holder is insertable into the seat 8 from the rear side of the connection block. While inserted the slotted forward end returns to its unloaded shape, the lip 11 engaging the edge which defines the forward end of the seat 8.

The contact holder 6 comprises a first and forward seat 12 arranged for insertion of a rear end of the connector 5. The engagement between contact holder and connector is detachable, including by way of example a threaded engagement. In mounted position, the forward sleeve-shaped portion of the contact holder 6 is internally supported against the exterior of the connector, to which purpose the connector may be formed with a radially protruding shoulder 13. The shoulder 13 may be slightly conical in order to urge the slotted forward end to be radially expanded, securing this way a firm attachment of the contact holder to the connection block.

Separated from the first/forward seat 12 is a second rearward seat 14 arranged in the opposite end of the contact holder 6. This second/rear seat 14 is arranged for insertion of an electrical conductor in the contact holder 6, through which electricity is transferred to the connector 5.

This far through the description a connection block is disclosed, having connectors effective for conducting electrical power and/or signals controlling the operation of rail vehicle functions, typically characterized by a sinus-shaped signal oscillating at a frequency of 50 Hz. Transferring data at broadband capacity of 100 Mbit/second under an Ethernet protocol requires conducting of a square wave oscillating at 100 000 Hz, or 100 MHz, frequency. Under such conditions the connector 5 will operate as an antenna by which external electromagnetic fields and activity will interfere and cause noise to the signal, which must be protected by a surrounding metal screen in the connection area.

A connector 5' which is modified for connecting data communication networks at broadband capacity in rail vehicles is illustrated in FIGS. 3*a* and 3*b*, showing a pair of mating connectors in longitudinal sections. Each connector 5' comprises a metal contact housing 20 arranged for insertion in the forward end of the contact holder 6, and a metal contact member 21 seated in the contact housing, the contact member 21 extending through the contact housing to a conductor termination 22 seated in the rear end of the contact holder 6. The contact housing 20 is detachably mounted in the forward seat 12, and the conductor termination is received in the rear seat 14 of the contact holder as explained above.

The contact member 21 is supported in a central bore 23 through the contact housing 20, and insertable form the forward end of the contact housing 20. The contact member comprises a body 24 having a first diameter, and a rod 25 having a second diameter lesser than the first diameter, the rod extending from the body in the rearward direction. The body 24 is arrested inside the bore in both axial directions. To this purpose, the bore 23 has forward and rear shoulders 26 and 27 formed with a radial dimension in the bore. Spacer elements 28, 29 made of dielectric material, such as a polymer material, are inserted between the radial shoulders and opposite end surfaces of the body 24. At least one spacer element 28 is made of elastic material and flexible in a radial dimension, and is this way insertable in the bore under radial compression. While being inserted under radial compression, the flexible spacer element is allowed to expand radially behind the forward shoulder, this way axially arresting the body 24 of the contact member behind the forward shoulder 26.

In the illustrated embodiment the spacer elements 28, 29 are supported coaxially on the contact member 21 and provide a centring of the contact member in the bore through the contact housing. The spacer elements this way ensure the formation of an annular gap 30 providing electric isolation of the contact member inside the contact housing.

The rod 25 extends from the body 24 through the contact housing 20, such that a rear end 31 of the rod projects outside the rear end of the contact housing. A tube 32 made of dielectric material runs concentric with the rod, providing isolation of the rod from the metal contact housing 20. The rear end 31 of the rod projects into the rear seat 14 of the contact holder, via a passage 33, to engage the conductor termination 22 which is received in the rear seat 14. The conductor termination 22 can be a plug socket as illustrated, fixedly arranged in the rear seat by means of an inter-positioned sleeve 34 made of dielectric material. The conductor 35 is here typically a single conductor included in a four-wire Ethernet circuit, albeit the present connector may find use also in other applications.

On the left hand side of FIG. 3*a* a connector 5' is shown having a contact housing 20 of female shape. The contact member 21 here includes a contact pin 36 extending from the forward end of the contact member's body 24, to a distant slightly within the mouth of the female contact housing. On the right hand side of FIG. 3*b* a connector 5' is shown having a contact housing 20 of male shape. The contact member 21 here includes a contact sleeve 37 mouthing in the end of the contact member body 24, at a distant slightly inside the end of the male contact housing. In coupling operations, the extended contact housings 20 are brought in contact with a mating connector in advance of the associated contact members 21, providing guidance of the same in the coupling manoeuvre, as well as protection in uncoupled conditions.

In order to ensure electrical contact in coupled operation, flexible contact elements or wire sleeves may be inserted in the contact sleeve 37, as illustrated at 38 in FIGS. 3*a* and 3*b*. Contact surfaces may also be conventionally plated for the same purpose.

By introducing the connector 5' in a connection block supported on a train coupler, the train coupler and connection block are provided a capacity for broadband communication between interconnected rail vehicles. The provision of a 100 Mbit data interface between rail vehicles is also in practise a prerequisite for installation of broadband capacity in rail vehicles, which is realized through the electromagnetically shielded connector 5' of the present invention.

LIST OF REFERENCES

1 Train coupler
2 Draw bar
3 Coupler head
4 Connection block
5 Connector
6 Contact holder
7 Body
8 Seat
9 Sleeve
10 Slot
11 Lip
12 Seat
13 Shoulder
14 Seat
15-19 (not in use)
20 Contact housing
21 Contact member
22 Conductor termination
23 Central bore
24 Body
25 Rod
26 Forward shoulder
27 Rear shoulder
28 Spacer element
29 Spacer element
30 Annular gap
31 Tube
32 Passage
33 Sleeve
34 Conductor
35 Contact pin
36 Contact sleeve
37 Contact element

The invention claimed is:

1. A connector (5) by which signals are conducted between data communication networks separately installed in coupled rail vehicles, said connector comprising:

a contact holder (6) arranged to be seated in a train coupler connection block (7);

a metal contact housing (20) arranged for insertion in a forward end of the contact holder (6); and a metal contact member (21) seated in the contact housing, the metal contact member extending electrically separated through the contact housing to a conductor termination (22) seated in a rear end of the contact holder (6), wherein the metal contact member (21) comprises a metal body (24) having a diameter, and a rod (25) of a smaller diameter extending from the body, the body seated in a central axial bore (23) through the contact housing (20) and the rod (25) reaching axially outside a rear end of the contact housing (20).

2. The connector of claim 1, wherein the contact holder (6) has a forward seat (12) arranged for seating the rear end of the contact housing (20), and a rear seat (14) separated from the forward seat, the rear seat arranged for seating a cable conductor termination (22), and a passage (33) from the forward seat to the rear seat for passing of the rod (25) of the metal contact member (21) into the rear seat.

3. The connector of claim 2, wherein the body (24) of the metal contact member is axially arrested between forward and rear radial shoulders (26, 27) formed in the bore (23) through the contact housing (20), wherein spacer elements (28, 29) made of dielectric material are interposed between the shoulders (26, 27) and the opposite ends of the body (24) of the metal contact member.

4. The connector of claim 3, wherein the spacer elements (28, 29) are supported on the metal contact member (21) and effects centring of the metal contact member in concentric relation with the contact housing (20), the spacer elements ensuring an annular gap (30) between the bore and the body of the metal contact member.

5. A connector (5) by which signals are conducted between data communication networks separately installed in coupled rail vehicles, said connector comprising:

a contact holder (6) having a forward end arranged to be seated in a seat (8) of a train coupler connection block (7);

a metal contact housing (20) arranged for insertion in the forward end of the contact holder (6);

a conductor termination (22) seated in, and extending rearwardly outward from, a rear end of the contact holder (6); and a metal contact member (21) seated in the contact housing (6), the metal contact member (21) extending, electrically separated, through the contact housing (20) from the forward end of the contact holder (6) to the conductor termination (22) seated in the rear end of contact holder (6).

* * * * *